US005836365A

United States Patent [19]

Derecktor

[11] Patent Number: 5,836,365

[45] Date of Patent: Nov. 17, 1998

[54] PORTABLE WORK BENCH HAVING MULTIPLE ACCESSORIES

[75] Inventor: Thomas E. Derecktor, Fall River, Mass.

[73] Assignee: TracRac, Inc., Fall River, Mass.

[21] Appl. No.: 878,972

[22] Filed: Jun. 19, 1997

[51] Int. Cl.[6] ..... B25H 1/00

[52] U.S. Cl. ..... 144/287; 83/452; 83/468.1; 144/286.1; 144/286.5; 108/131; 108/132; 182/181; 269/303; 269/901

[58] Field of Search ..... 144/1.1, 286.1, 144/286.5, 287; 83/452, 467.1, 468, 468.7; 108/131, 132, 133, 127; 269/139, 154, 303, 304, 901, 902; 182/181, 184

[56] References Cited

U.S. PATENT DOCUMENTS

| | | | |
|---|---|---|---|
| 3,229,994 | 1/1966 | Klein . | |
| 3,406,728 | 10/1968 | Rost . | |
| 3,695,189 | 10/1972 | Felder, Jr. | 144/287 |
| 3,762,763 | 10/1973 | Deshores . | |
| 3,901,548 | 8/1975 | Seaman, Jr. . | |
| 4,215,894 | 8/1980 | Sidlinger . | |
| 4,341,247 | 7/1982 | Price . | |
| 4,398,763 | 8/1983 | Louw . | |
| 4,527,786 | 7/1985 | Hsu . | |
| 4,527,827 | 7/1985 | Maniscalco et al. . | |
| 4,650,383 | 3/1987 | Hoff . | |
| 4,693,158 | 9/1987 | Price | 144/287 |
| 4,864,941 | 9/1989 | Goulter . | |
| 4,969,784 | 11/1990 | Yanke . | |
| 4,974,898 | 12/1990 | Baranski . | |
| 5,002,324 | 3/1991 | Griffin . | |
| 5,052,739 | 10/1991 | Irwin . | |
| 5,067,535 | 11/1991 | Wolff . | |
| 5,137,320 | 8/1992 | Christensen . | |
| 5,139,375 | 8/1992 | Franchuk . | |
| 5,143,415 | 9/1992 | Boudah . | |
| 5,152,570 | 10/1992 | Hood . | |
| 5,190,337 | 3/1993 | McDaniel . | |
| 5,203,603 | 4/1993 | Hertzberg et al. . | |
| 5,238,280 | 8/1993 | Christensen . | |
| 5,301,726 | 4/1994 | Wojcik . | |
| 5,303,858 | 4/1994 | Price . | |
| 5,310,238 | 5/1994 | Wheatley . | |
| 5,316,190 | 5/1994 | Bullock . | |
| 5,393,114 | 2/1995 | Christensen . | |
| 5,443,554 | 8/1995 | Robert . | |
| 5,494,327 | 2/1996 | Derecktor . | |
| 5,592,981 | 1/1997 | Derecktor | 144/286.1 |

FOREIGN PATENT DOCUMENTS

| | | |
|---|---|---|
| 2 276 114 | 9/1994 | United Kingdom . |

*Primary Examiner*—W. Donald Bray
*Attorney, Agent, or Firm*—Salter & Michaelson

[57] ABSTRACT

A portable work bench includes a track having a structural body, and four collapsible legs for supporting the track in an elevated position above a surface. The work bench further includes a dual purpose accessory releasably attachable to the track. The dual purpose accessory has a body, a rail member for slidably mounting the body on the track so that the body is movable along the length of the track, a locking member for locking the body at a desired position along the length of the track, and a dual purpose accessory having two attaching formations for attaching the member to the body of the accessory in a first position in which the member supports an item placed thereon and in a second position in which the member engages the item. A tape measuring device having a case and a reeled tape can be secured to the body of the accessory such that tape is extended from the case and releasably attached to the primary accessory for measuring the cut off length of the item to be cut. An extension assembly is further disclosed for extending the overall length of the work bench. All accessories can be released and removed directly off the track or slide off the ends of the track.

18 Claims, 8 Drawing Sheets

PORTABLE WORK BENCH HAVING MULTIPLE ACCESSORIES

BACKGROUND OF THE INVENTION

This invention relates generally to portable work benches, and more particularly to a portable work bench having uniquely designed and configured accessories and pivotal legs for enhancing the versatility of the work bench.

This invention is primarily directed as an improvement to this inventor's work bench disclosed in U.S. Pat. No. 5,592,981. This patent discloses a work bench including a track having an elongate tubular body with a thin wall which defines substantially the entire outer perimeter of the tubular body. The work bench further comprises support means embodying four retractable legs for supporting the track in an elevated position above a surface. A sliding lock assembly is releasably attachable to the rail member, the sliding lock assembly including a sliding lock member slidably mounted on the rail member of the track and movable along the length of the rail member. A thumb turn screw is provided for locking the sliding lock member at a desired position along the length of the rail member. The sliding lock assembly is especially suited for mounting an accessory, such as a power miter saw thereon.

The work bench further includes a separate work support accessory which supports an item, such as a piece of lumber, on the work bench. Also, a work stop accessory is further included for providing an engagement surface which engages the end of an item during cutting so as to establish cutting lengths, for example. The work support and work stop accessories are formed from different parts which require separate machining and assembly; thus, the provision of two separate work support and work stop accessories increases the overall cost of the work bench since they have differing constructions and require separate tooling and machining. In addition, these prior accessories, in order to be attached to and removed from the work bench, had to slide on and off the end of the track of the work bench.

In addition, the legs of the work bench, while particularly effective in adjusting the height of the track of the work bench, do have certain disadvantages. For example, a pair of legs is attached to the track by a large bracket and two small brackets with a pair of nut and bolt fasteners. The legs are pivotally connected to the body of the track by the brackets between a collapsed position and an extended or use position. For locking each pair of legs in place, a pair of sliding members, one for each leg, are mounted by the other smaller bracket to the underside of the body of the track by suitable fasteners. Each sliding member is pivotally attached to the smaller bracket by another nut and bolt fastener at one end thereof, and is slidably attached at its other end to its respective leg.

As stated above, this construction is particularly effective in adjusting the height of the work bench, but is extremely detailed in construction and greatly increases the overall cost of the work bench. In this regard, its many and varied components are difficult to manufacture. Moreover, to assemble the work bench requires an excessive amount of labor.

Another disadvantage associated with the above-described work bench is that in order to measure a cutting length, one must first manually measure the distance between the blade of the saw and the work stop with a separate tape measure, or pre-mark the lumber prior to cutting. It would be advantageous to have a tape measuring system built into the work bench so that one can preset the work stop at the desired cutting length without having to pre-mark the lumber.

The foregoing illustrates limitations known to exist in present portable work bench constructions. Thus, it is apparent that it would be advantageous to provide an improved portable work bench which overcomes one or more of the limitations set forth above. Accordingly, a suitable alternative is provided including features more fully disclosed hereinafter.

SUMMARY OF THE INVENTION

In general, the present invention is directed to a portable work bench comprising a track having structural body, and support means for supporting the track in an elevated position above a surface. The work bench further comprises a dual purpose accessory releasably attachable to the track. The dual purpose accessory comprises a body, mounting means for slidably mounting the body on the track so that the body is movable along the length of the track, locking means for locking the body at a desired position along the length of the track, and a member having attaching means for attaching the member to the body of the accessory in a first position in which the member supports an item placed thereon and for attaching the member to the body in a second position in which the member engages the item.

In a second aspect of the present invention, the work bench comprises a track having structural body, support means for supporting the track in an elevated position above a surface, a primary accessory releasably attachable to the track, and a secondary accessory releasably attachable to the track. The secondary accessory has a body, mounting means for slidably mounting the body on the track so that the body is movable along the length of the track, locking means for locking the sliding lock member at a desired position along the length of the track, and a tape measuring device secured to the body. The tape measuring device has a case and a reeled tape spring biased to be reeled into the case. The arrangement is such that tape is extended from the case and releasably attached to the primary accessory for measuring the distance between the primary and secondary accessories.

In a third aspect of the present invention, a portable work bench comprises a track having a structural body, an accessory releasably attachable to the track, one pair of legs mounted to the track at one end thereof and another pair of legs mounted at the other end thereof, and for each leg, pivotal connection means for attaching the leg to the underside of the track. The pivotal connection means comprises a bracket positively secured to the underside of the structural body of the track, a hinge pin connecting the leg to the bracket, and a detent element for retaining the leg in one of three positions, a closed position in which the leg is generally parallel to the track and below the opposing leg, a second closed position in which the leg is above the opposing leg, and an open position in which the leg extends generally away from the track.

In a fourth aspect of the present invention, the work bench comprises a track having a structural, tubular body, one pair of legs mounted to the track at one end thereof and another pair of legs mounted at the other end thereof, and an extension assembly for extending the overall length of the work bench. The extension assembly comprises a track having a tubular body, one pair of legs mounted to the track of the extension assembly at one end thereof, an extension segment for interconnecting the track of the work bench and the track of the extension assembly, and means for locking the extension segment to the tracks of the work bench and extension assembly.

Accordingly, among the several objects of the present invention are the provision of an improved portable work bench having sliding connections for releasably and adjustably attaching accessories, such as a saw mount and/or work support/stop assemblies, to the work bench; the provision of such a work bench which is sturdy in design and lightweight; the provision of such a work bench which can be broken down to a compact configuration suitable for transport or storage; the provision of such a work bench having sliding connections with a plurality of rail members on each track which receive sliding members for mounting various accessories to the work bench, the accessories being slidably movable along the rail members independently from the work bench; the provision of such a work bench which easily transforms between a compact stowed configuration and an open use configuration; the provision of such a work bench which has a reduced amount of components that results in lower cost of manufacture and less time to assemble; the provision of such a work bench which has a built-in tape measure for quickly and efficiently measuring cut off lengths; and the provision of such a work bench which is durable in use.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENTS

Figure 1:
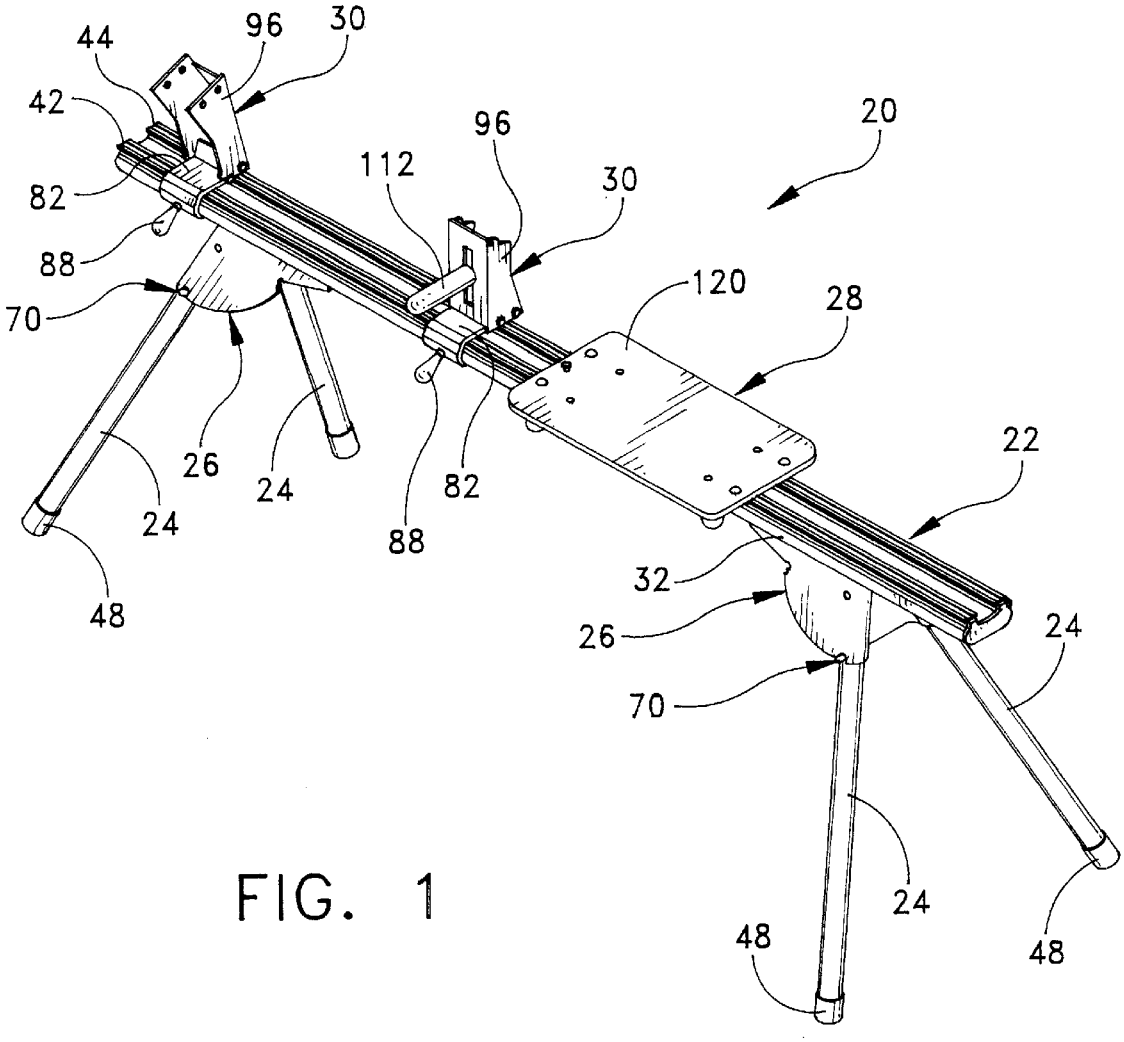
FIG. 1 is a perspective view of a portable work bench of the present invention.
Figure 2:
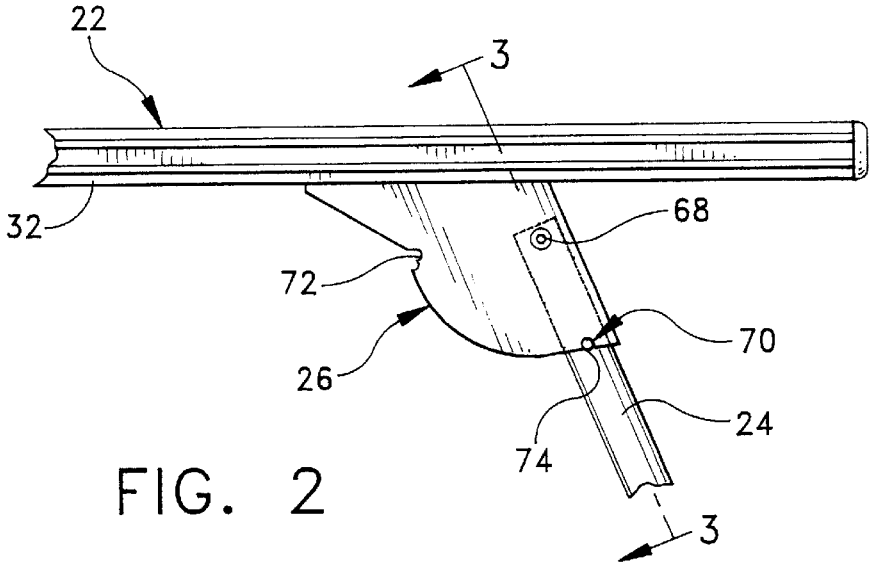
FIG. 2 is an enlarged elevational view of the connection of a leg to a track of the work bench, the leg being shown in an open, use position.

Referring now to the drawings, and more particularly to FIGS. 1 and 2, there is generally indicated at 20 a work bench of the present invention. The work bench 20 is especially suited for portable use since it can be broken down to a compact configuration and easily assembled to achieve a use configuration when it is desired to use the work bench. As illustrated in FIG. 1, the work bench 20 comprises an elongate track, generally indicated at 22, four legs, each indicated at 24, a pair of legs being located at each end of the track 22, and connection brackets, generally indicated at 26, for mounting the legs 24 to the track 22. Most of these components can be fabricated from lightweight material which is rugged, such as extruded aluminum.

The work bench 20 further comprises multiple accessories, including a saw mount assembly, generally indicated at 28, and a pair of adjustable work support/stop assemblies, each generally indicated at 30. These assemblies are slidably mounted on the track 22, and will be described in greater detail as the description of the work bench 20 proceeds.

The track 22 is a structural member designed to carry the loads applied thereon by the accessories (e.g., saw mount assembly 28 and work support/stop assembly 30). The saw mount assembly 28 is designed to receive a portable saw (not shown) thereon in the manner well-known in the art. Each accessory is designed so that it can be easily mounted on and taken off the track 22 by hand without having to resort to using tools. This enables the work bench 20 to be easily assembled and disassembled by hand, thereby facilitating the manner in which it is used by the ordinary consumer.

The adjustable work support/stop assembly 30 is provided for supporting and/or stopping items to be cut by the portable saw, such as lumber. In its support position, the assembly 30 supports items, whereas in its stop position, it provides an engagement surface which engages the ends of items during cutting so as to establish cutting lengths, for example. The work bench 20 of the present invention enables its user to adjust the location of the assemblies 28, 30 so as to more efficiently utilize the entire length of the track 22. For example, by placing the saw mount assembly 28 at one end of the track 22, one work support/stop assembly 30 in the middle of the track 22, and the other work support/stop assembly 30 at the other end of the track 22, the user of the work bench 20 can cut (or manipulate with some other tool) a piece of lumber which is relatively long. Moreover, since the work bench 20 is portable and easily assembled and disassembled, it can be broken down to a compact configuration and transported to another work site. All accessories can be released and removed directly off the track or slide off the ends of the track.

Figure 3:
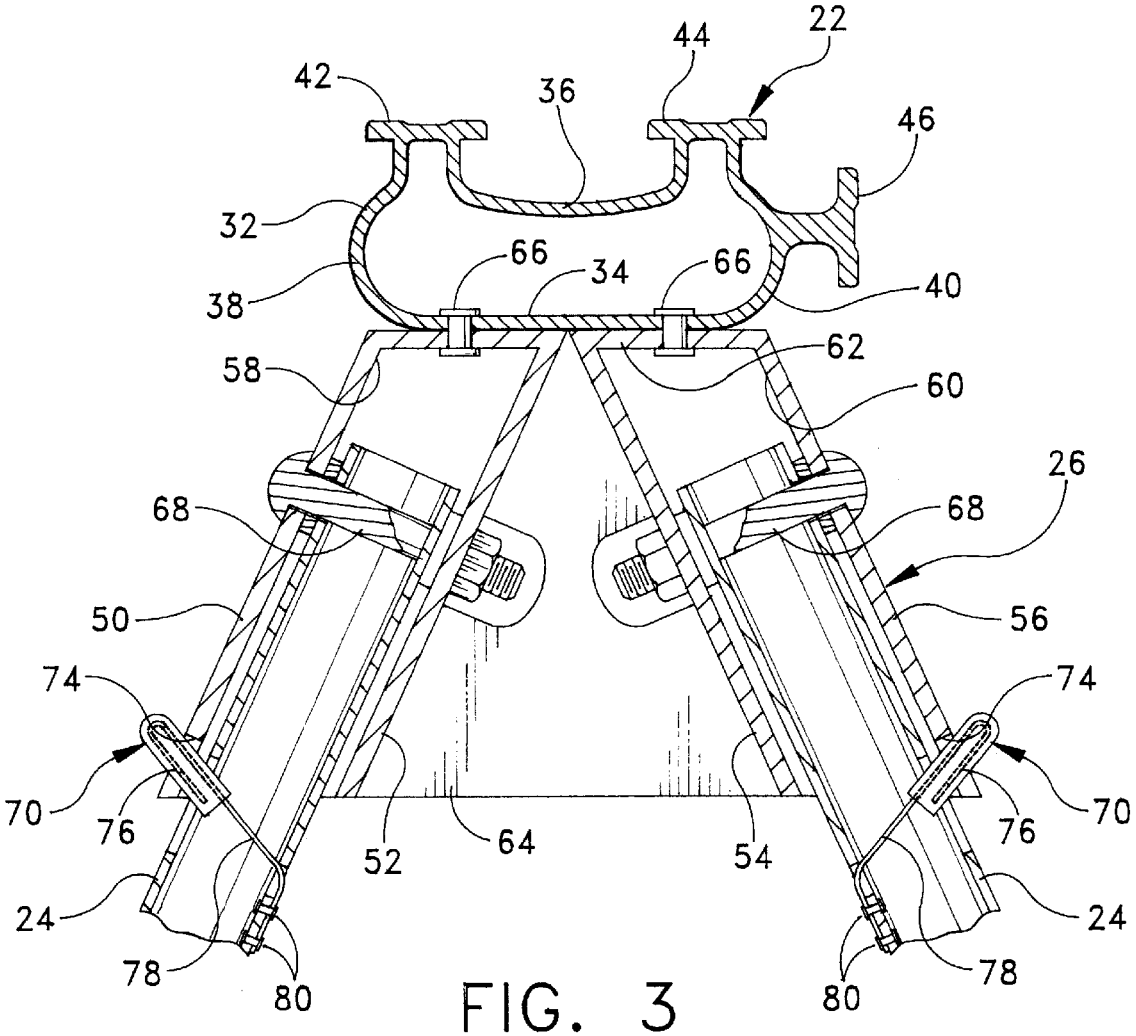
FIG. 3 is a cross-sectional view of the work bench taken along line 3—3 in FIG. 2.

Referring to FIG. 3, the track 22 of the work bench 20 has an elongate, structural tubular body 32 comprising a thin wall which defines substantially the entire outer perimeter of the tubular body. The tubular nature of the track 22 enables it to withstand substantial amounts of torsional and lateral loads applied thereto. It should be noted that other structural members, such as I-beams, channel members, and the like can be used instead of the tubular body. However, the tubular body 32 is lightweight while maintaining its durability and structural nature. The tubular body 32 includes a bottom wall 34, a top wall 36 opposite the bottom wall 34, and a pair of side walls 38, 40 which interconnect the bottom and top walls 34, 36, respectively.

Integrally formed with the elongate tubular body 32 are three rail members 42, 44 and 46, each being designed to receive and attach the saw mount assembly 28 and the adjustable work support/stop assemblies 30 thereon. Each rail member 42, 44 and 46 is generally rectangular in cross section and extends along the length of the tubular body 32 of the track 22. It should be understood that any number of rail members may be provided on the track 22, such as two rail members, and that the provision of three rail members 42, 44 and 46 gives the user added versatility for mounting other items onto the work bench 20. As shown, the first and second rail members 42, 44 are mounted on the top wall 36 of the elongate tubular body 32 and the third, side rail member 46 is mounted on side wall 40 of the body 32. Preferably, as mentioned above, the track 22 is fabricated from extruded aluminum which has been found to be lightweight, easy to manufacture and strong in construction. However, the track 22 can also be made from materials other than aluminum exhibiting the characteristics of aluminum (e.g., strong and lightweight).

Turning now to FIGS. 3–6, the construction and attachment of the legs 24 to the track 22 is illustrated in these drawing views. More specifically, each leg 24 is tubular in construction and includes a rubber or synthetic rubber foot 48 for preventing the leg 24 from permanently marking the surface upon which it rests. At each end of the track 22, the connection bracket 26 is mounted on the underside (i.e., on bottom wall 34) of the track 22. Each connection bracket 26 includes four walls 50, 52, 54 and 56, the two left-hand parallel walls 50, 52 (see FIG. 3) defining a channel 58 for one leg 24, and the two right-hand parallel walls 54, 56 defining another channel 60 for the other leg 24. One way of fabricating each channel 58, 60 is by bending one piece of material so as to create the two walls 50, 52 or 54, 56 which define the channel. The connection bracket 26 further includes a top wall 62 and a cross wall 64 for stabilizing the bracket. The top and cross walls 62, 64 interconnect the left-hand walls 50, 52 and the right-hand walls 54, 56. The bracket 26 is secured to the bottom wall 34 of the track 22 by rivets 66 which extend through aligned openings (not shown) formed in the structural body 32 of the track 22 and the bracket 26. It should be noted that other types of fasteners can be used for achieving this connection.

Figure 4:
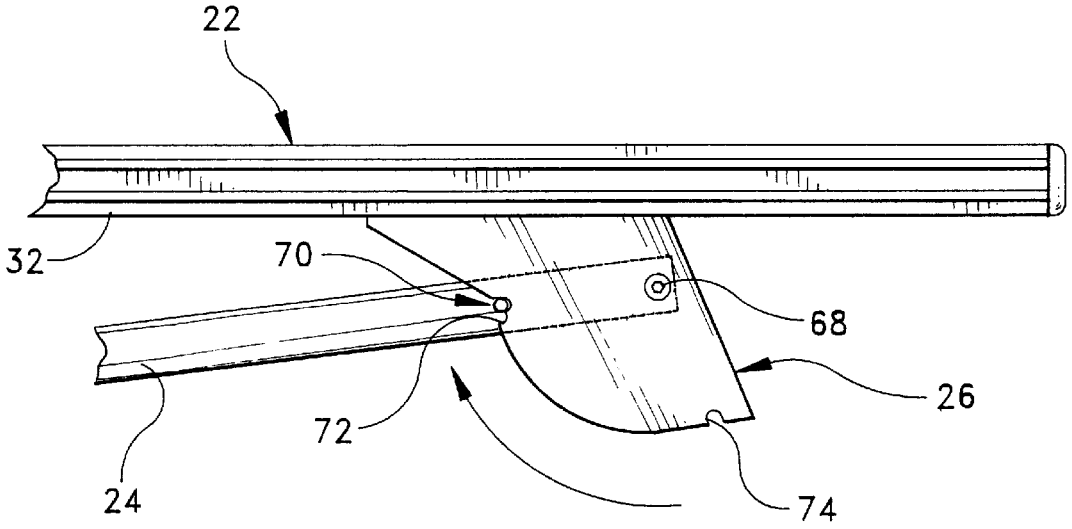
FIG. 4 is an elevational view similar to FIG. 2 with the leg being shown in a closed, stowed position.

The upper portion of each leg 24 is connected to its respective left-hand walls 50, 52 or right-hand walls 54, 56 of the connection bracket 26 by a hinge pin 68 which embodies a machine bolt and nut fastener arrangement. As shown in FIG. 3, the hinge pin 68 extends through aligned openings (not shown) formed in the walls 50, 52 or 54, 56 of the bracket 26 and the leg 24. It should further be noted that other types of fasteners (e.g., rivets) could be used as well instead of the hinge pins 68. As illustrated in FIGS. 2 and 4, each leg 24 is pivotable between an open position (FIG. 2) in which the leg 24 extends generally away from the track 22 and a closed position (FIG. 4) in which the leg 24 is generally parallel to the track 22.

In order to maintain the leg 24 in either its open or closed position, a detent element, generally indicated at 70, is provided. The detent element 70 is received in one of two spaced-apart notches 72, 74 formed in the outer wall 50 and 56 of the connection bracket 26 for retaining the leg 24 in its open or closed position. These notches 72, 74 are formed on the peripheral edges of the outer walls 50 and 56 of the bracket 26.

Figure 5:
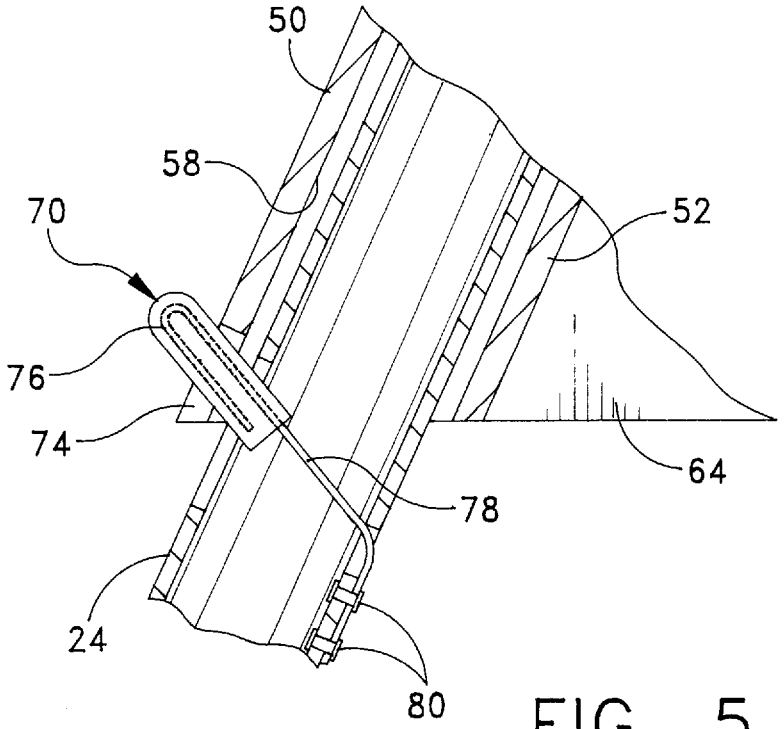
FIG. 5 is a detailed cross-sectional view similar to FIG. 3 of a detent element of the leg in an extended position.
Figure 6:
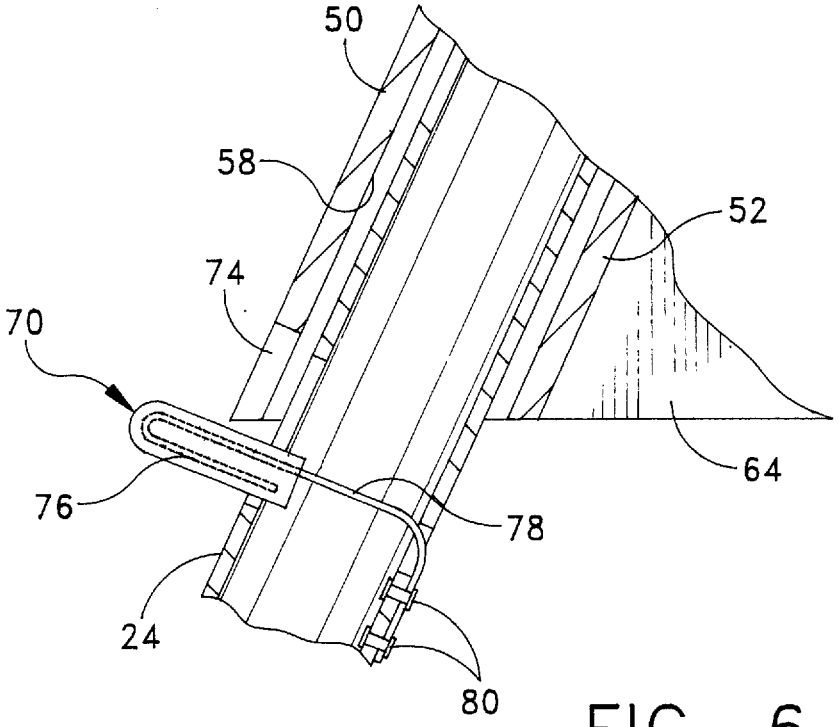
FIG. 6 is a detailed cross-sectional view of the detent element shown in FIG. 5 with the detent element being illustrated in a retracted position.

Referring now to FIGS. 5 and 6, the detent element 70 is movable between an extended position in which it extends laterally outwardly for engaging the outer peripheral edge of the outer wall 50 or 56 and a retracted position in which the detent element 70 is moved inwardly within the leg 24. The detent element includes a head portion 76 and a spring 78 for biasing the head portion 76 to the extended position. The head portion 76 extends through an opening (not designated) formed in the leg, the opening being sized to enable the head portion 76 to pass freely therethrough. The spring 78 is attached to the leg 24 by a pair of rivets, each indicated at 80, as illustrated in FIGS. 5 and 6.

Each leg 24 pivots within its respective channel 58 or 60 and is moved by first depressing the head portion 76 of the detent element 70 so that it is retracted, and then pivoting the leg 24 about the hinge pin 68. During this pivoting action, the detent element 70 is engaging the inner surface of the outer wall 50 or 56. Once it is moved to either its open or closed position, the detent element 70 extends through the notch 72 or 74 and is retained therein by virtue of the shape and construction of the notch. Only by depressing the detent element 70 to its retracted position so that it disengages the wall 50 or 56 can the leg 24 be pivoted.

Figure 7:
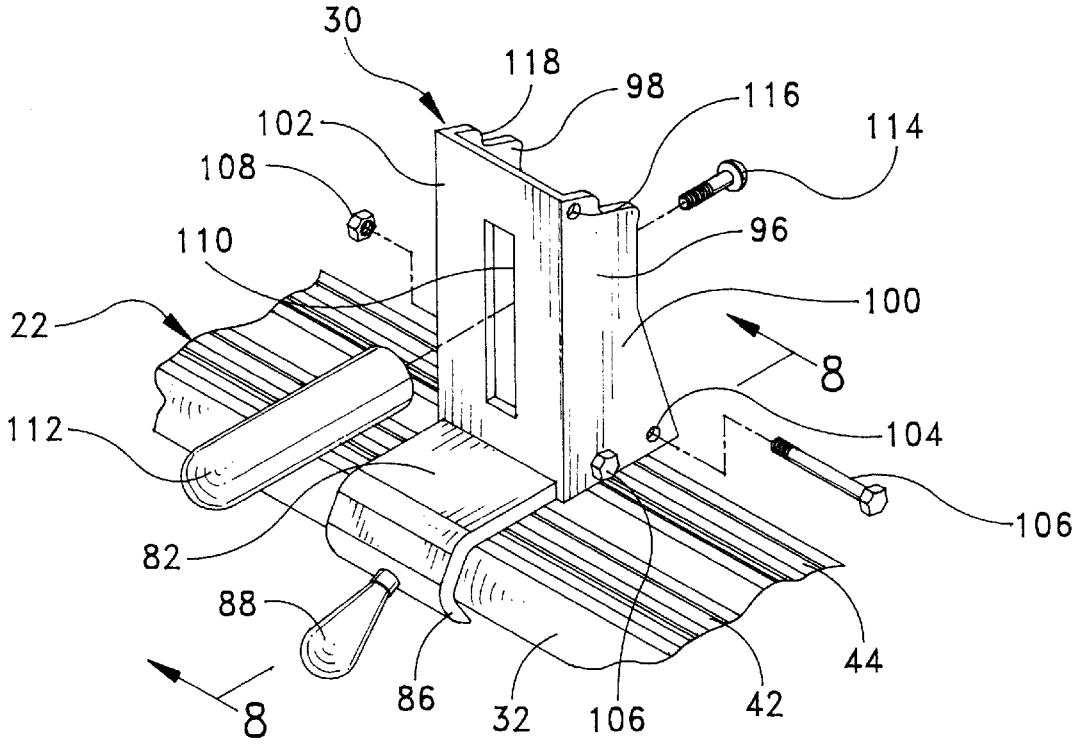
FIG. 7 is a fragmentary perspective view of a work support/stop assembly of the work bench, the assembly being illustrated in its work support position.
Figure 8:
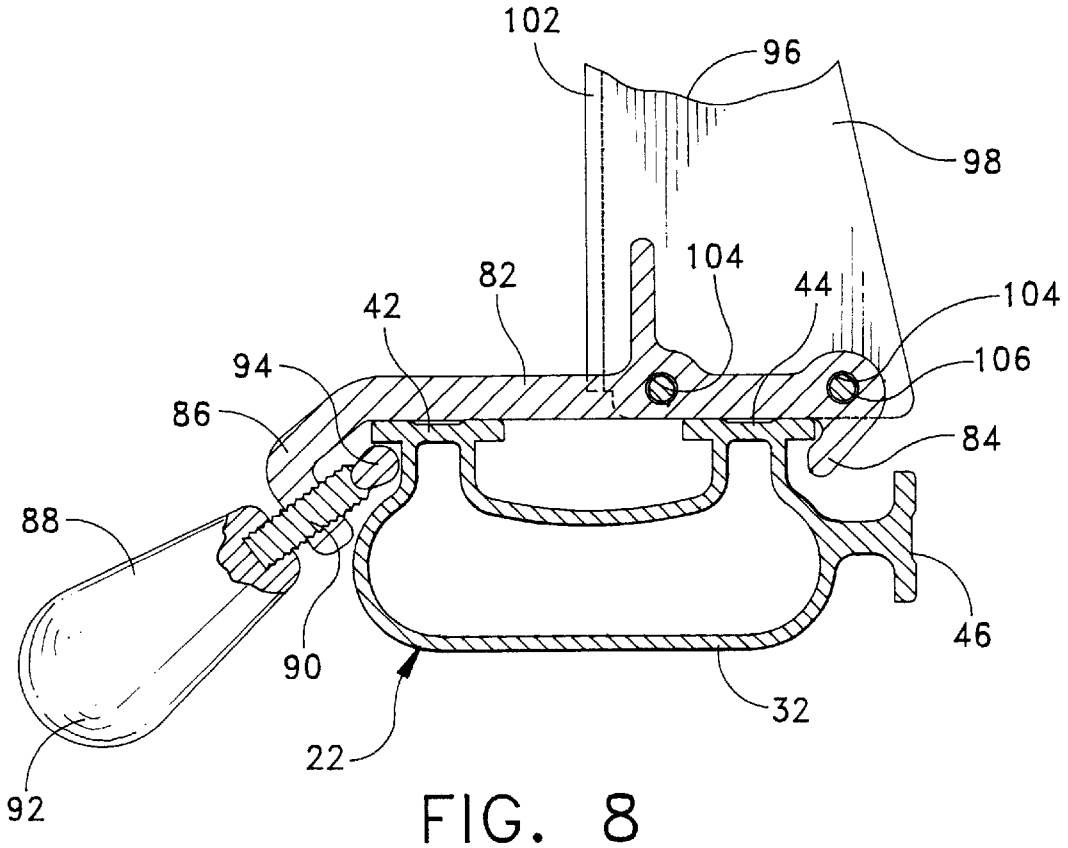
FIG. 8 is a cross-sectional view of the work support/stop assembly taken along line 8—8 in FIG. 7.

Turning to FIGS. 7 and 8, the work support/stop assembly 30 is illustrated in its work support position. The assembly 30 includes a body 82 which rides along the two upwardly facing rails 42, 44 of the track 22. The body 82 includes mounting means embodying a first lateral flange 84 located along one end of the body 82 for engaging one of the rail members (i.e., rail member 44), and a second lateral flange 86 located at the other end of the body 82. Unlike the first flange 84, the second lateral flange 86 is spaced from the other rail member 42.

A threaded opening (not shown) is formed in the second flange 86, this opening threadably receiving a stud assembly 88 therein which is capable of locking the body 82 of the work support/stop assembly 30 to the structural body 32 of the track 22. As shown, the stud assembly 88 includes a stud 90 and a handle 92 attached to the outer free end of the stud 90 for facilitating the turning of the stud by hand when moving the stud assembly into locking engagement with the rail member (e.g., rail member 42 shown in FIG. 8). Preferably, the stud assembly 88 also includes a plastic insert 94 at the other free end of the stud 90 for engaging the underside of the rail member. The purpose of the plastic insert 94 is for preventing damage from occurring to the rail member (e.g., rail member 42) and structural body 32 when tightening the stud assembly 88.

The work support/stop assembly 30 further includes a reversible member 96 which is capable of being releasably mounted on the body 82 in one of two positions. In FIGS. 7 and 8, the reversible member 96 is being shown in its work support position. As shown, the reversible member 96 is generally channel-shaped in construction, having a pair of outer walls 98, 100 and a connecting wall 102 disposed therebetween. A pair of openings 104 are formed in lower edge margins of the outer walls 98, 100 for receiving threaded fasteners 106 (e.g., machine bolts) therethrough. Clearance bores are formed in the body 82 of the assembly 30 so that the fastener 106 extends therethrough wherein a nut fastener 108 secures the fastener 106 thereto. Other means for releasably attaching the reversible member 96 to the body 82 can be employed as well so long as the reversible member 96 is securely fastened to the body for supporting items, such as lumber, in the manner to be described below.

The connecting wall 102 has a slot 110 formed therein for facilitating the securement of a support rod 112 to the connecting wall 102 of the reversible member 96. As shown, another fastener 114 is provided for releasably securing the support rod 112 to the reversible member 96, the slot 110 enabling the rod 112 to be positioned at a desired height with respect to the track 22. The fastener 114 is threadably received in a threaded bore (not shown) formed in the end of the support rod 112. Once assembled, the support rod 112 is capable of supporting a piece of lumber thereon in an elevated position so that the lumber is generally horizontal during its manipulation. The provision of the support rod 112 enables the item to be elevated at a height which corresponds to the height of the working surface of the tool mounted on the saw mount assembly 28 (e.g., a table saw).

Figure 9:
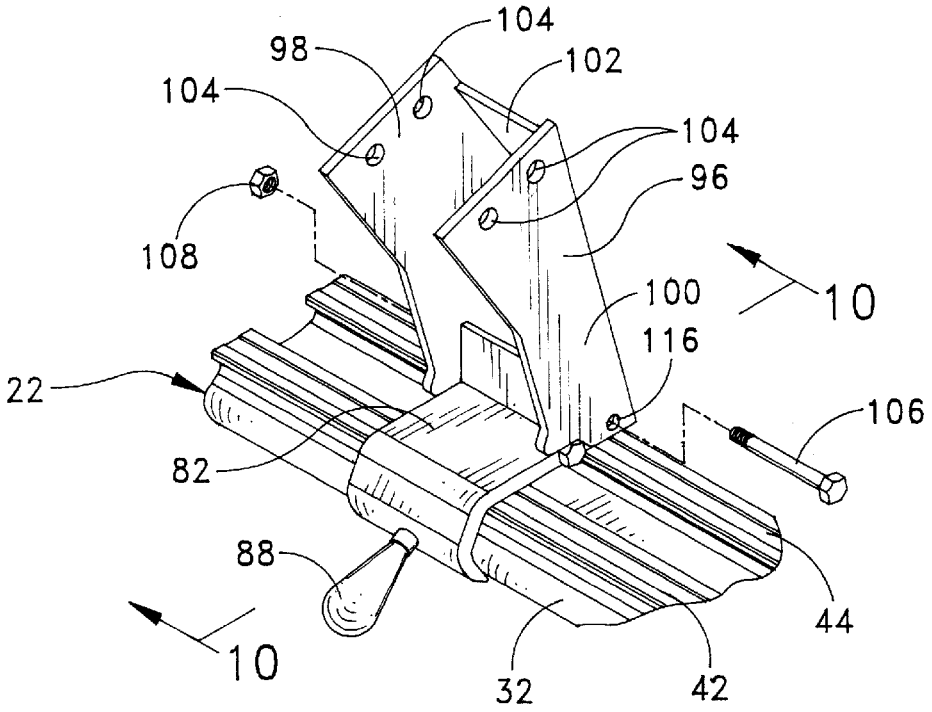
FIG. 9 is a fragmentary perspective view of the work support/stop assembly as substantially shown in FIG. 7 but with the assembly being illustrated in its work stop position.
Figure 10:
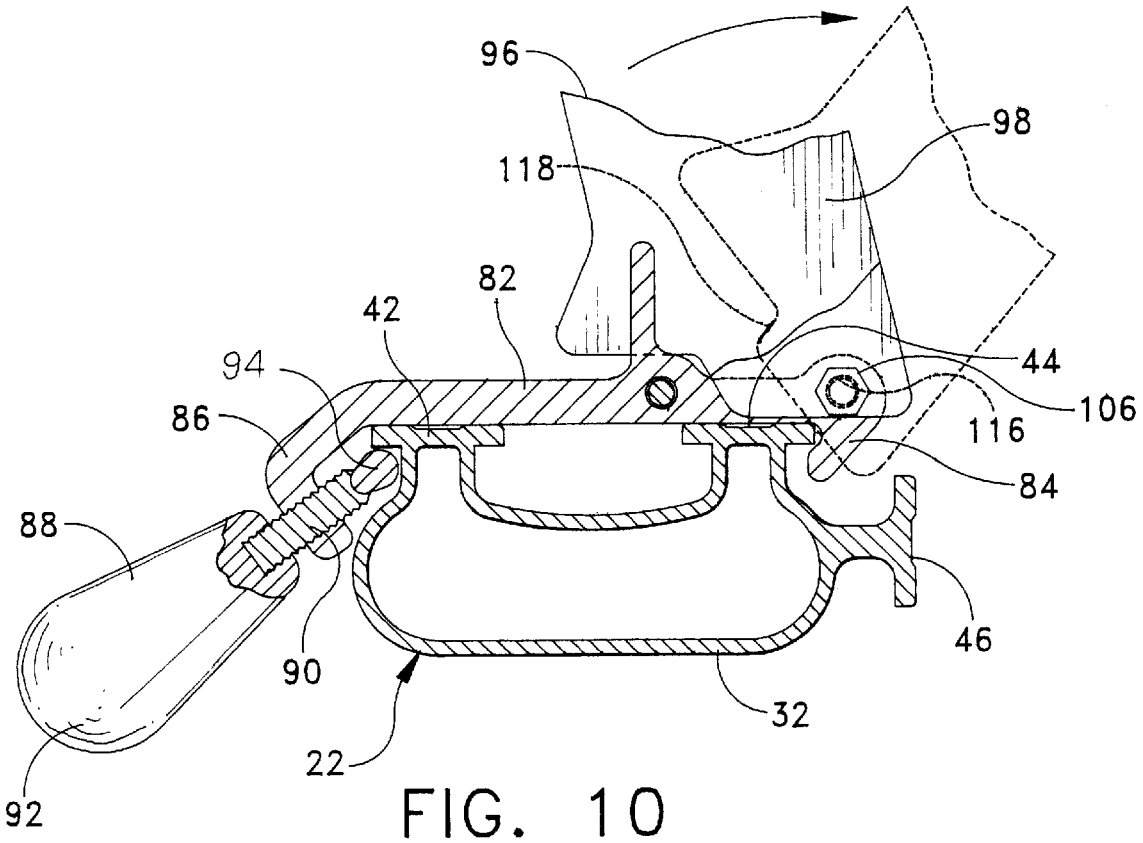
FIG. 10 is a cross-sectional view of the work support/stop assembly taken along line 10—10 in FIG. 9.

Referring to FIGS. 9 and 10, the work support/stop assembly 30 is illustrated in its work stop position. This position is achieved by rotating the reversible member 96 so that the other end of the member is positioned adjacent the body 82 of the assembly 30. Only one clearance opening 116 is formed in the outer walls 98, 100 of this end of the member 96 wherein the fastener 106 releasably secures the member 96 to the body 82. As shown, the other fastener 106 is secured to the body 82 for engaging the edge of the reversible member 96. More specifically, a shoulder 118 is formed in the edge of the outer walls 98, 100 of the reversible member 96, the other fastener 106 being received within the shoulder 118. The reversible member 96, since it is secured to the body 82 by only one fastener 106, is capable of pivoting about the fastener 106 in the manner depicted in FIG. 10. When pivoted so that the shoulder 118 engages the other fastener 106, this suitably positions the reversible member 96 for engaging the item wherein the outer wall 100 provides an engagement surface for engaging the item. When being used as a stop, the support rod 112 is simply removed from the reversible member 96 and stored in a safe location.

Thus, it should be observed that the dual purpose work support/stop assembly 30 of the present invention can both support an item, such as a piece of lumber, and engage the lumber so that an accurate cut can be made, depending upon what position the reversible member 96 of the assembly 30 is employed. By merely removing the fasteners 106 and reversing or flipping over the reversible member 96, the assembly can be configured with the aid of a wrench (not shown) to achieve its work support or work stop position. The work stop and work support can also be made as individual units as one-piece extrusions.

Figure 11:
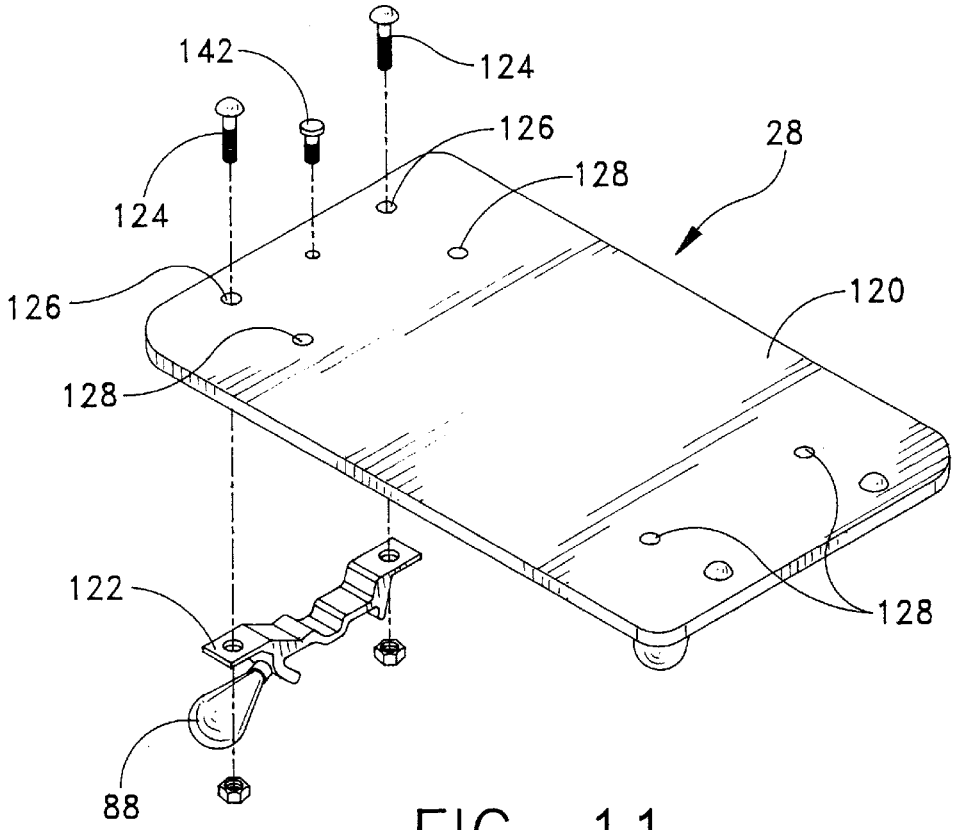
FIG. 11 is a perspective view of a saw mount assembly of the work bench.
Figure 12:
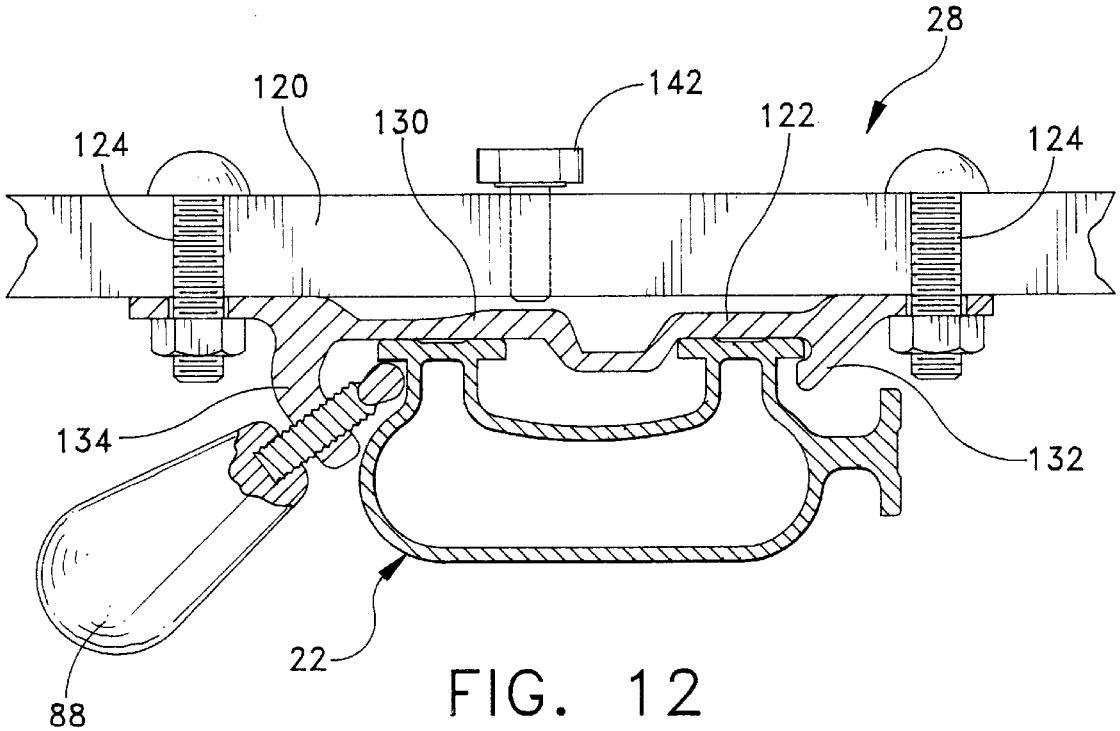
FIG. 12 is a cross-sectional view of the work bench illustrating the connection of the saw mount assembly to the track.

Referring to FIGS. 11 and 12, and particularly to FIG. 11, the saw mount assembly 28 includes a support plate 120 and a pair of mounting brackets 122 for mounting the support plate 120 to the track 22. FIG. 11 only illustrates one such bracket 122 but it should be understood that two brackets should be utilized when mounting the plate 120 on the track 22 in a stable manner. The bracket 122 is secured to the support plate 120 by a pair of nut and bolt fasteners, each indicated at 124. The fasteners extend through clearance openings 126 formed in the support plate 120. Four other openings 128 are provided for attaching an accessory, such as a table saw, to the support plate 120. It should be noted that any suitable arrangement can be provided for securely attaching the accessory to the support plate 120.

The mounting bracket 122 operates on the same principle as the body 82 of the work support/stop assembly 30 in that it includes a body 130 having first and second lateral flanges 132, 134 for engaging the rail members 44, 42, respectively. The second flange 134 has a threaded opening (not shown) formed therein for receiving a stud assembly 88 for locking the support plate 120 of the saw mount assembly 28 in place. It should be noted that only one of the brackets 122 requires the stud assembly 88 for securely locking the saw mount assembly 28.

Figure 13:
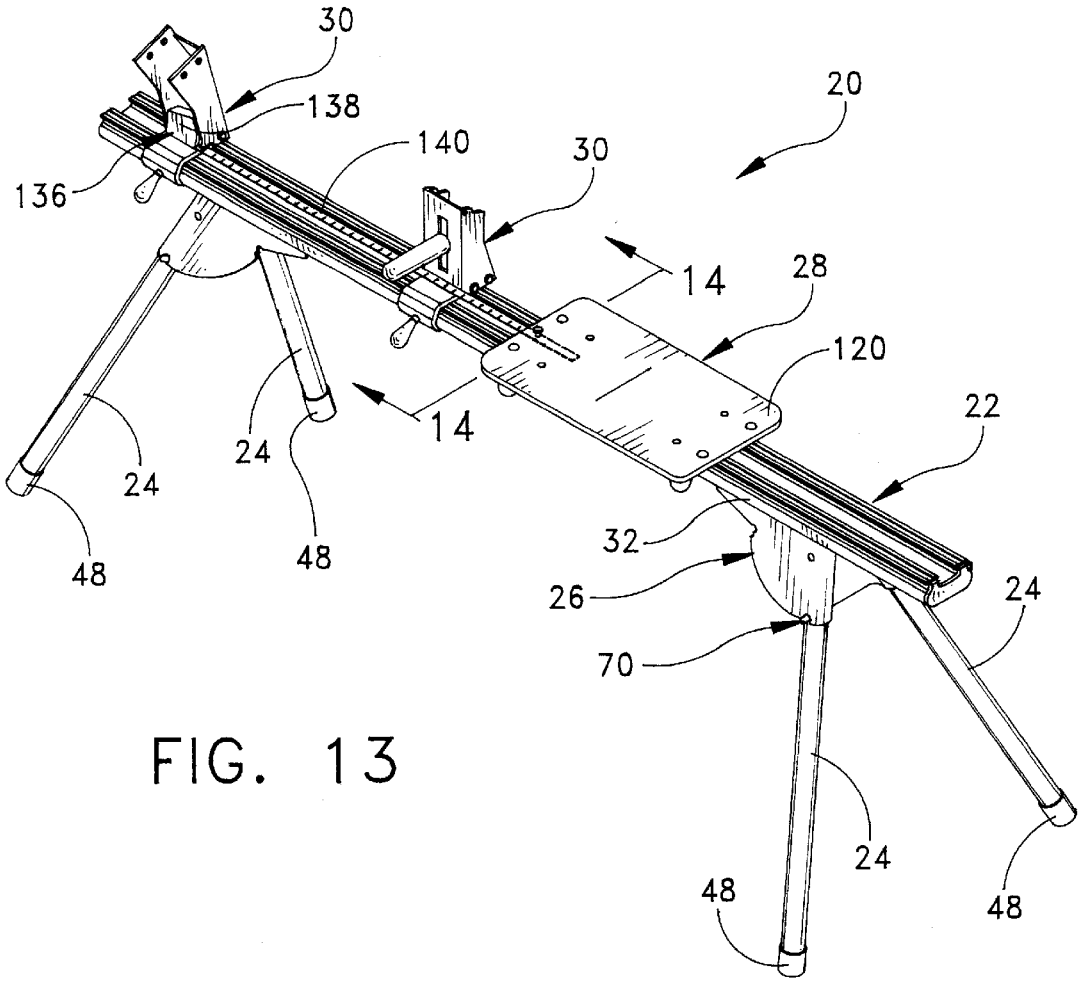
FIG. 13 is a perspective view of the work bench illustrating a built-in tape measuring device mounted on one of the work support/stop assemblies.
Figure 14:
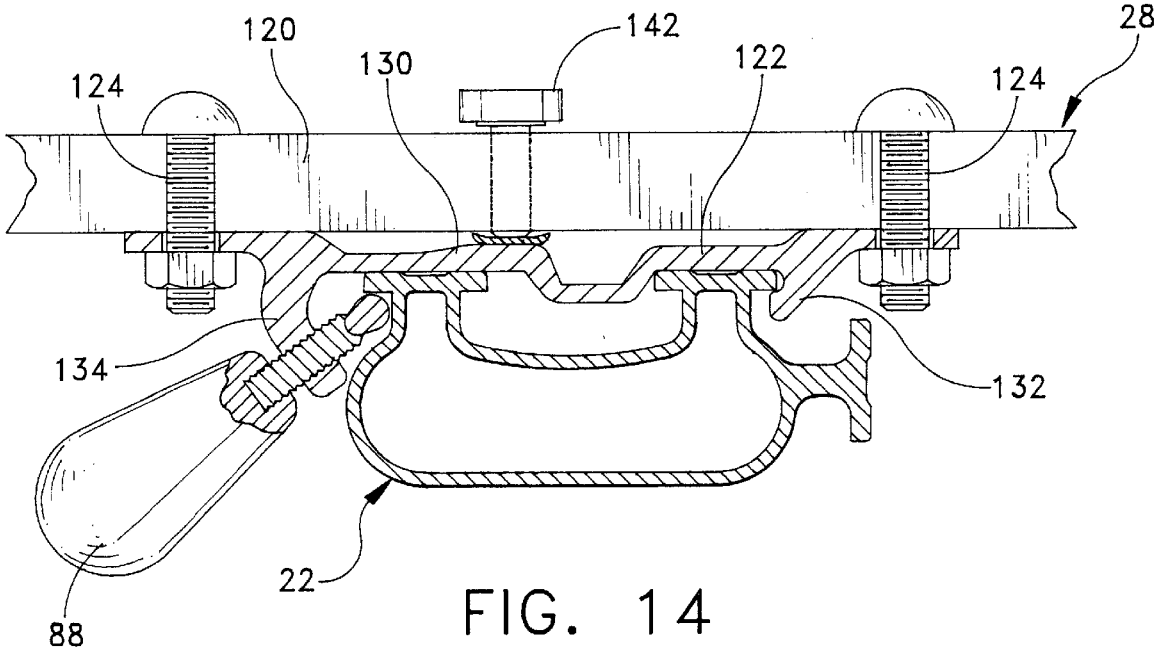
FIG. 14 is a cross-sectional view of the saw mount assembly taken along line 14—14 in FIG. 13.

As illustrated in FIGS. 13 and 14, a tape measuring device, generally indicated at 136, is suitably mounted on the body 82 of the work support/stop assembly 30. The purpose of the tape measuring device 136 is to accurately measure items to be cut or manipulated in some fashion without having to either measure the lumber or the distance from the work stop assembly 30 to a saw mounted on the saw mount assembly 28, for example. The provision of a built-in tape measure eliminates this time consuming and awkward process, especially when cutting long lengths.

The tape measuring device 136 is of standard construction, having a case 138 and a reeled tape 140 which is spring biased to be reeled into the case 138. The case 138 of the tape measuring device 136 is secured to the body 82 of the assembly 30 by any appropriate means in a position where the tape 140 is dispensed toward the saw mount assembly 28 along the length of the track 22. The tape 140 is extended from the case 138 and releasably attached to the support plate 120 of the saw mount assembly 28 by a thumb turn member 142 which is threadably attached to a threaded opening (not shown) formed in the support plate 120. As shown in FIG. 14, the thumb turn member 142 is turned so that it engages the tape 140 between the member 142 and the body 130 of the bracket 122. The tape 140 is adjusted to the point where the readout of the measurement against the face of the body 130 or an added clear plastic readout attached to the body 130, is the same as the distance between the face of the body 130 and the side of the saw blade of a mounted saw. This distance need only be calibrated once with a ruler or pre-cut lumber of a predetermined length. The tape 140 is then secured to the support plate 120 and bracket 122 by the thumb turn member 142.

To utilize the tape measuring device 136 of the work bench 20, one need only release the far left work support/stop assembly 30 and move that assembly to the length desired for cutting as displayed by reading out against the face of the body 130 or an attached plastic readout. Once the assembly 30 is in place, the stud assembly 88 is tightened for locking the assembly 30 to the track 22. At this point, a piece of lumber, for example, can be placed on the work bench 20 and cut by a table saw mounted on the table saw mount assembly 28.

Figure 15:
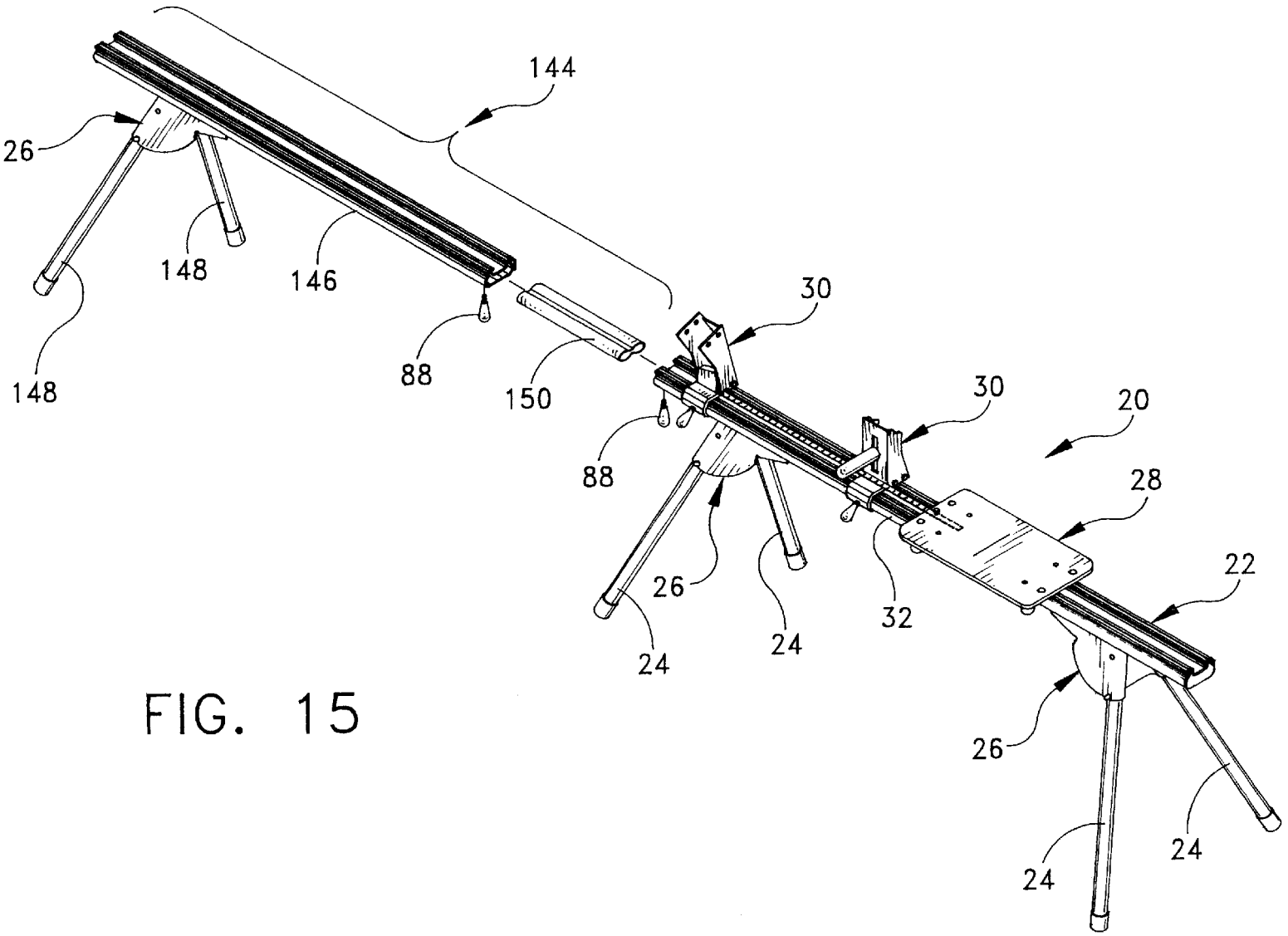
FIG. 15 is a perspective view of the work bench illustrating an extension assembly of the work bench.

Lastly, turning to FIG. 15, there is generally indicated at 144 an extension assembly which is designed to extend the length of the work bench 20. As shown, the extension assembly 144 includes a length of track 146, a pair of legs each indicated at 148 secured to the track 146 by a connection bracket 28, and an extension segment 150 which slides within the track 22 of the work bench 20 and within the track 146 of the extension assembly 144 for interconnecting the two together. The track 146 is constructed in an identical manner as track 22. The extension segment 150 is sized for being received within the tubular structural bodies of the tracks 22, 146. Preferably, the segment 150 is extruded from aluminum, or some other similar material as specified for the tracks 22, 146. A pair of stud assemblies 88 are received within threaded openings (not shown) formed in the structural bodies of the track 22 and the extension track 146 for connecting the extension assembly 144 to the work bench 20. When tightened, the stud assemblies 88 engage the extension segment 150 for securing the segment 150 to the tracks 22 and 146. The extension assembly 144 is particularly suited for extending the length of the work bench 20 to accommodate larger items. It should be noted that the extension assembly 144 is secured to the work bench 20 by hand without the need of tools.

It should be observed that the portable work bench 20 of the present invention is constructed of relatively few parts, thus reducing the cost of its manufacture and assembly. Moreover, the built-in tape measuring device 136 enables a person using the work bench 20 to quickly and effectively measure an item to be cut by simply moving the work support/stop assembly 30 upon which it is secured. Also, the length of the work bench 20 can easily be extended by hand with the extension assembly 144 without having to resort to any tools. It can therefore be seen that for these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A portable work bench comprising:

a track having a structural body;

support means for supporting the track in an elevated position above a surface; and a dual purpose accessory releasably attachable to the track, said dual purpose accessory comprising a body, mounting means for slidably mounting the body on the track so that the body is movable along the length of the track, locking means for locking the body at a desired position along the length of the track, and a member having attaching means for attaching the member to the body of the accessory in a first position in which the member supports an item placed therein and for attaching the member to the body in a second position in which the member engages the item.

2. The portable work bench as set forth in claim 1, said track having at least one rail member attached to the structural body and extendable along the length of the body, said rail member being generally rectangular in cross section.

3. The portable work bench as set forth in claim 2, said body of the dual purpose accessory having a first lateral flange located at one end of the body for engaging the rail member, and a second lateral flange located at the other end of the body, said second flange being spaced from said rail member.

4. The portable work bench as set forth in claim 3, said locking means comprising a threaded opening formed in the second flange and a stud threadably received in the threaded opening, said stud being adapted to engage the rail member of the track when tightening said stud for locking the body of the dual purpose accessory to the structural body of the track.

5. The portable work bench as set forth in claim 4, said locking means further comprising a handle attached at an end of the stud, said handle facilitating the turning of the stud by hand for moving the stud into locking engagement with said rail member when tightening said stud.

6. The portable work bench as set forth in claim 2, said track further comprising a second rail member mounted on said structural body.

7. The portable work bench as set forth in claim 1, said structural body of the track being tubular, and comprising a thin wall which defines substantially the entire outer perimeter of the body.

8. The portable work bench as set forth in claim 1, said support means comprising one pair of legs mounted to said track at one end thereof and another pair of legs mounted at the other end thereof.

9. The portable work bench as set forth in claim 8, each leg being attached to the underside of the structural body of the track by pivotal connection means.

10. The portable work bench as set forth in claim 9, said pivotal connection means comprising a bracket positively secured to the underside of the structural body of the track, a hinge pin connecting the leg to the bracket, and a detent element for retaining the leg in one of at least two positions, a closed position in which the leg is generally parallel to the track and an open position in which the leg extends generally away from the track.

11. The portable work bench as set forth in claim 10, said bracket comprising a pair of spaced-apart notches for receiving the detent element when positioning the leg in its closed and open positions.

12. A portable work bench comprising:

a track having a structural body;

support means for supporting the track in an elevated position above a surface;

a primary accessory releasably attachable to the track; and a secondary accessory releasably attachable to the track, said secondary accessory having a body, mounting means for slidably mounting the body on the track so that the body is movable along the length of the track, locking means for locking the sliding lock member at a desired position along the length of the track, and a tape measuring device secured to the body, said tape measuring device having a case and a reeled tape spring biased to be reeled into the case, wherein said tape is extended from the case and releasably attached to the primary accessory for measuring the distance between the primary and secondary accessories.

13. The portable work bench as set forth in claim 12, said primary accessory comprising a body, mounting means for slidably mounting the body on the track so that the body is movable along the length of the track, and locking means for locking the sliding lock member at a desired position along the length of the track.

14. The portable work bench as set forth in claim 13, said primary accessory further having a device for releasably attaching the tape to the body of the primary accessory.

15. The portable work bench as set forth in claim 12, said secondary accessory further having a member having attaching means for attaching the member to the body in a first position in which the member supports an item placed therein and for attaching the member of the body in a second position in which the member engages the item.

16. A portable work bench comprising:

a track having a structural body;

an accessory releasably attachable to the track;

one pair of legs mounted to said track at one end thereof and another pair of legs mounted at the other end thereof; and for each leg, pivotal connection means for attaching the leg to the underside of the track, said pivotal connection means comprising a bracket positively secured to the underside of the structural body of the track, a hinge pin connecting the leg to the bracket, and a detent element for retaining the leg in one of at least two positions, a closed position in which the leg is generally parallel to the track and an open position in which the leg extends generally away from the track.

17. The portable work bench as set forth in claim 16, said bracket comprising a pair of spaced-apart notches for receiving the detent element when positioning the leg in its closed and open positions.

18. A portable work bench comprising:

a track having a tubular body;

one pair of legs mounted to said track at one end thereof and another pair of legs mounted at the other end thereof; and an extension assembly for extending the overall length of the work bench, said extension assembly comprising a track having a tubular body, one pair of legs mounted to the track of the extension assembly at one end thereof, an extension segment for interconnecting the track of the work bench and the track of the extension assembly, and means for locking the extension segment to the tracks of the work bench and extension assembly.

* * * * *